US006032415A

United States Patent [19]

Tajima

[11] Patent Number: 6,032,415

[45] Date of Patent: Mar. 7, 2000

[54] POWER WINDOW APPARATUS HAVING SAFETY UNIT

[75] Inventor: Keiichi Tajima, Shizuoka, Japan

[73] Assignee: Koito Manufacturing Co., Ltd., Tokyo, Japan

[21] Appl. No.: 09/264,031

[22] Filed: Mar. 8, 1999

[30] Foreign Application Priority Data

Mar. 13, 1998 [JP] Japan ..... 10-062755

[51] Int. Cl.[7] ..... E05F 15/02

[52] U.S. Cl. ..... 49/28; 49/26; 49/348

[58] Field of Search ..... 49/26, 27, 28, 49/31, 348, 349, 352; 318/266, 286, 468, 470, 264, 265, 466, 467; 200/61.43, 19.01, 19.18, 47; 192/142 R

[56] References Cited

U.S. PATENT DOCUMENTS

| | | | |
|---|---|---|---|
| 2,826,658 | 3/1958 | Jackson | 49/28 |
| 3,050,931 | 8/1962 | Horning | 200/19.18 |
| 3,076,065 | 1/1963 | Dimeff | 200/19.01 |
| 4,631,461 | 12/1986 | Peugeot | 49/28 |
| 4,887,205 | 12/1989 | Chou | 49/28 |
| 5,147,989 | 9/1992 | Ito | 200/19.01 |
| 5,175,478 | 12/1992 | Chen | 49/349 |
| 5,230,179 | 7/1993 | Richmond et al. | 49/28 |
| 5,351,439 | 10/1994 | Takeda et al. | 49/28 |
| 5,404,673 | 4/1995 | Takeda et al. | 49/28 |
| 5,773,947 | 6/1998 | Torii et al. | 318/466 |
| 5,818,358 | 10/1998 | Torii et al. | 318/466 |
| 5,924,949 | 7/1999 | Fan | 49/28 |

*Primary Examiner*—Daniel P. Stodola
*Assistant Examiner*—Curtis A. Cohen
*Attorney, Agent, or Firm*—Sughrue, Mion, Zinn, Macpeak & Seas, PLLC

[57] ABSTRACT

A power window apparatus for detecting accidental pinching in a power window in accordance with the opened/closed position of the window and a state of rotation of a motor which is structured to improve the accuracy of the operation of a position sensor for detecting a safety-control suspension region for the window. A pair of contacts are disposed on the side surface of a main gear which is rotated by an output shaft of a motor for opening/closing a window. A conductive film opposite to the contacts is provided for a sub-gear engaged to the main gear through an interlocking gear and arranged to be rotated at different speed from that of the main gear. When the relative rotational operation between the main gear and the sub-gear causes the output shaft of the motor to reach a predetermined amount of rotation, so that the window has moved to a predetermined opened/closed position, the contacts and the conductive film are brought into contact with one another so that an electric signal is output. Therefore, the safety-control suspension region can be detected at an accuracy of one-to-one correspondence to the amount of movement of the window.

4 Claims, 7 Drawing Sheets

POWER WINDOW APPARATUS HAVING SAFETY UNIT

BACKGROUND OF THE INVENTION

1. Field of the Invention

The present invention relates to a power window apparatus having a safety unit. The apparatus causes a window provided for a vehicle, such as an automobile, to be opened or closed by a motor, or the like, and performs a safety control operation for preventing pinching of the hand, the head, or other object, by the closing window. In particular, the present invention is directed to a power window apparatus having a structure in which a position sensor for detecting the position of the window is integrally provided with the motor.

2. Description of the Related Art

In general, a power window apparatus incorporates a drive source, such as a motor, which causes the window to perform an opening/closing operation. With such an apparatus, accidents occur wherein a hand or a head is pinched between the window glass and the sash as the window is being closed. Therefore, an apparatus incorporating a safety unit has been suggested which interrupts the operation for closing the window or causes the window to perform an opening operation when this type of accident is detected. A power window apparatus of the foregoing type is adapted to a method of detecting the pinching of a hand, for example, by measuring the opening/closing speed of the window or the rotational speed of the motor which correlates with the opening/closing speed. If the speed is reduced to a level lower than a reference value, i.e., if loads imposed on the window and the motor are enlarged due to the pinching action, the rotational speed is reduced, and thus, the pinching occurrence is detected.

The above-mentioned detecting method, however, encounters an error in detection of pinching when movement speed of the window or rotational speed of the motor has been reduced because of contact of the window glass with a weather strip provided for the sash. In other words, this detecting method erroneously detects a pinching scenario when the window glass reaches the weather strip as the window closes. As a result, the operation for closing the window is undesirably interrupted and, thus, the window cannot completely be closed. In a window incorporating a weather strip WS which has a cross sectional shape as shown in FIG. 7 and which is joined to a sash SS, the upper end of a window glass 7 starts making contact with the weather strip WS at a position about 4 mm before the full closed position for the window. Therefore, an error in detection occurs in the region in which the foregoing contact is made. However, since the above-mentioned gap of about 4 mm would only cause pinching of the leading end of a finger, if such pinching were to occur in this region it would not be a critical problem. Therefore, the region of 4 mm is made to be a safety-control suspension region. In other words, this region is not safety-controlled.

To recognize the safety-control suspension region, a technique has been suggested by which the position of the window is detected in accordance with an amount of rotation of the motor. However, a means for detecting an amount of rotation of the motor has a complicated structure which raises the overall cost of the window structure. The power window apparatus has a structure that the rotational force of the motor is transmitted to the window glass through a gear mechanism, a wire and pulley mechanism and so forth. Twist occurring in the direction of rotation considered to be caused from a damper provided for the gear mechanism, elongation of the wire and abrasion of the pulley cause deviation to occur between the rotational speed of the motor and the opened/closed position of the window. As a result, recognition of the safety control region by accurately detecting the opened/closed position of the window is hard to achieve, so that accurate recognition of the safety-control suspension region cannot easily be performed.

Therefore, the inventor of the present invention has suggested a power window apparatus having a structure incorporating a means for mechanically and electrically detecting the opened/closed position of the window. The safety-control suspension region is recognized in accordance with the detected opened/closed position of the window. As a means for mechanically and electrically detecting the opened/closed position of the window, a position sensor having a potentiometer structure is disposed adjacent to the closed position of the window. An output of the position sensor is used to recognize the safety-control suspension region. However, the above-mentioned apparatus requires a space for disposing the position sensor adjacent to the closed position of the window. Therefore, simplification of the structure and conservation of space in the vicinity of the window of an automobile cannot satisfactorily be realized.

In addition, since an error of the position at which the position sensor is mounted directly causes an error in detection of the opened/closed position of the window to occur, the position at which the position sensor is mounted must accurately be controlled. As a result, there arises a problem in that an operation for mounting the power window apparatus on the automobile cannot easily be completed. Another problem arises in that the accuracy to detect the position cannot easily be improved.

SUMMARY OF THE INVENTION

An object of the present invention is to provide a power window apparatus incorporating a motor having a safety unit for detecting the opened/closed position of a window, in order to eliminate the individual sensor for detecting the opened/closed position of the window and the corresponding space for disposing the sensor, while enabling a safety-control suspension region to accurately be detected.

A power window apparatus having a safety unit according to the present invention, comprises a position sensor for detecting an opened/closed position of a window which is opened/closed by a motor to perform a pinch preventive safety control operation in accordance with the detected opened/closed position, wherein the position sensor incorporates a main gear arranged to be rotated by an output shaft arranged to be rotated by the motor, a sub-gear disposed adjacent to the main gear in the axial direction and arranged to be rotated by the output shaft at a rotational speed which is different from that of the main gear, a contact provided for either of the main gear or the sub-gear and a conductive film provided for the sub-gear or the main gear provided with no contact and positioned on a movement locus of the contact, and a position detection signal of the window is output when the contact has been brought into contact with the conductive film.

According to the present invention, when the main gear has been rotated by the motor, the sub-gear is rotated at a different speed. Therefore, the contact provided for either gear is moved along the side surface of the other gear so as to be brought into contact with the conductive film at a predetermined rotational position. Thus, an electric signal is output. As a result, the predetermined rotational position of the motor, that is, the safety-control suspension region of the window of the power window apparatus, can be detected.

DETAILED DESCRIPTION OF THE INVENTION

Figure 1:
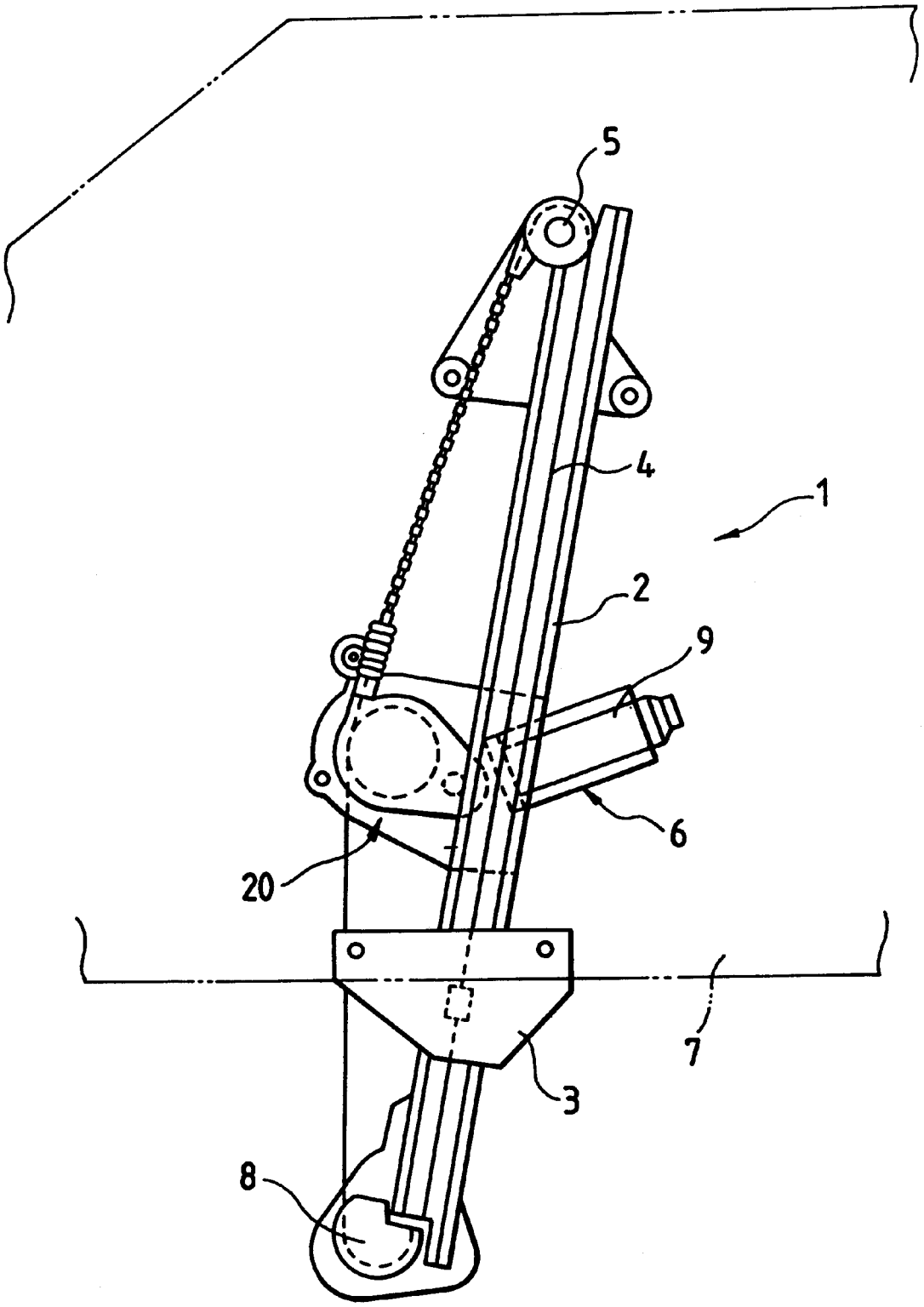
FIG. 1 is a side view showing the overall structure of a power window apparatus according to the present invention.

An embodiment of the present invention will now be described with reference to the drawings. FIG. 1 is an overall structural view showing a power window apparatus to which the present invention is applied. A window opening/closing mechanism 1 is disposed in a portion of a car body below the window (not shown) of an automobile. The window opening/closing mechanism 1 has a rail 2 extending vertically. The rail holds a slider 3 which is slidable in the vertical direction. A wire 4 is connected to the slider 3. The wire 4 is arranged between pulleys 5 and 8 disposed at upper and lower ends of the rail 2. Moreover, the wire 4 is allowed to run along a drive pulley 16 provided for a power-window moving portion 6 secured and supported at a substantially intermediate position of the rail. As described later, the power-window moving portion 6 is provided with a motor 9 for rotating the drive pulley 16. When the motor 9 has been rotated, the drive pulley 16 rotates the wire 4 to vertically move the slider 3. A window glass 7 is joined to the slider 3 so as to be moved vertically together with the slider 3 so that a window space formed by a sash is opened/closed.

Figure 2:
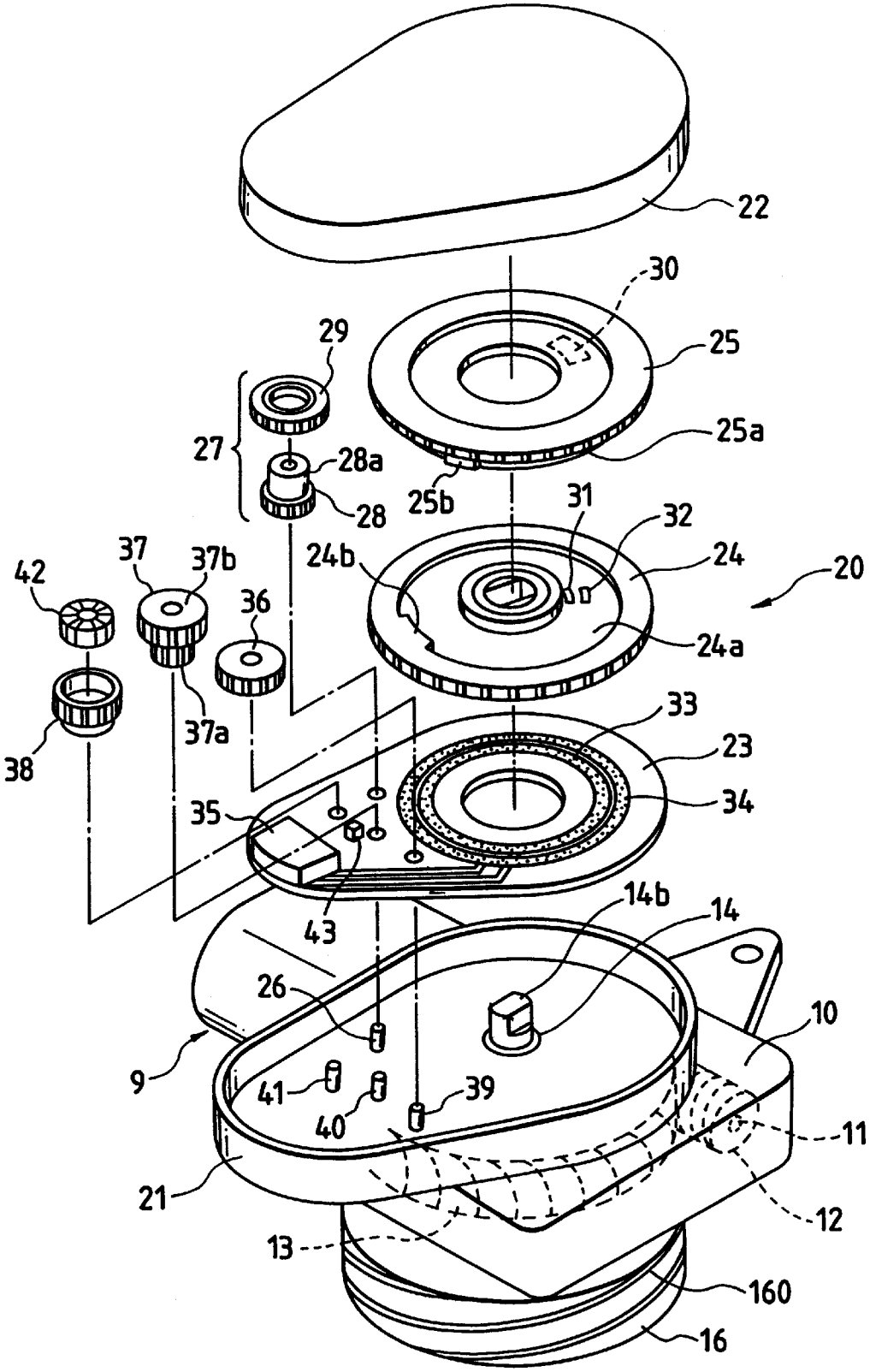
FIG. 2 is a partially-exploded perspective view showing a position sensor according to the present invention.
Figure 3:
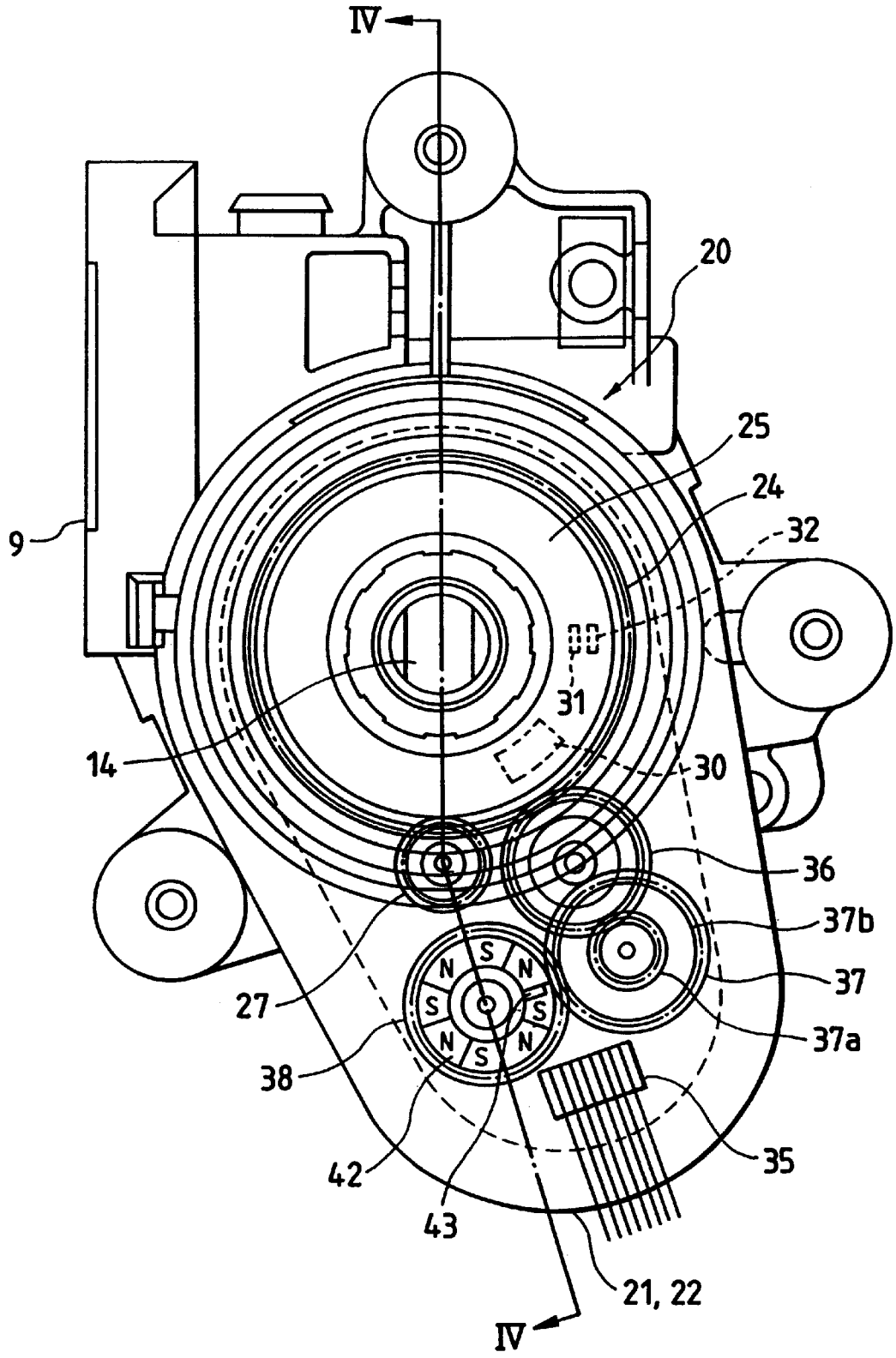
FIG. 3 is a plan layout view showing the position sensor shown in FIG. 2.
Figure 4:
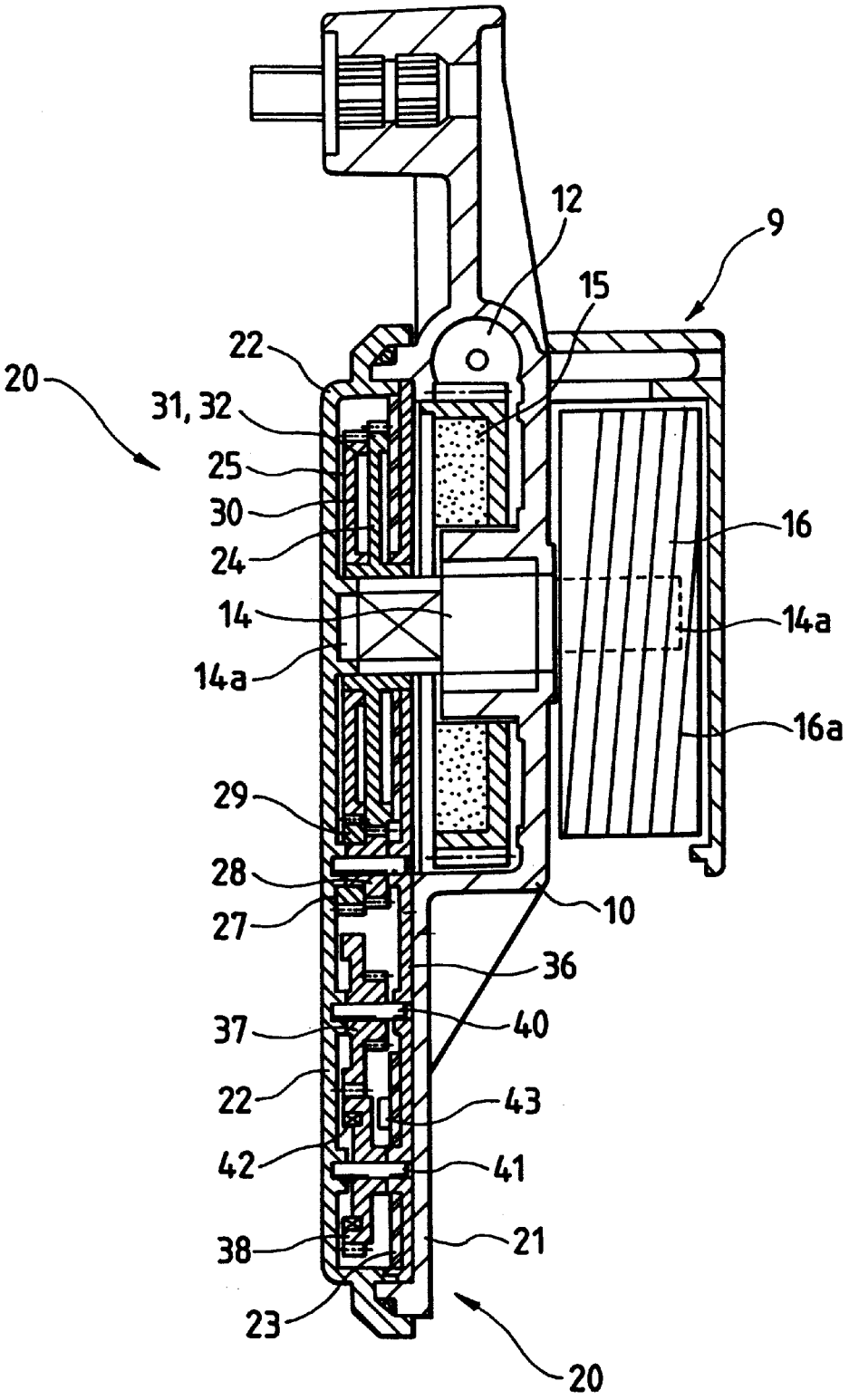
FIG. 4 is a cross sectional view taken along line IV—IV shown in FIG. 3.

FIG. 2 is a partially-broken perspective view showing the structure of the motor 9 of the power-window moving portion 6. FIG. 3 is a planar layout diagram showing the motor 9. FIG. 4 is a cross sectional view taken along line IV—IV shown in FIG. 3. The motor 9 has a basic structure which is the same as that of a conventional motor. A rotational shaft 11 is rotatively supported in a motor case 10 as indicated with a dashed line shown in FIG. 2. A motor actuator (not shown) rotates the motor 9. A worm 12 is integrally joined to the rotational shaft 11. A worm wheel 13 engaged to the worm 12 is rotated at reduced speed by dint of the rotational operation of the rotational shaft 11. Thus, the rotational force of an output shaft 14 which is a rotational shaft of the worm wheel 13 is output. A damper 15 (see FIG. 4) for damping a shock caused in the rotational direction is interposed between the worm wheel 13 and the output shaft 14. Two ends 14*a*, 14*b* of the output shaft 14 project over the two surfaces of the motor case 10. The end 14*a* of the two ends bears the drive pulley 16 disposed coaxially with the worm wheel 13 and is formed into a cylindrical container shape. The wire 4 for opening/closing the window glass 7 is wound around a spiral groove 16*a* formed in the outer surface of the drive pulley 16.

A position sensor 20 integrated with the motor 9 is connected to another end 14*b* of the output shaft 14. The position sensor 20 incorporates a housing 21 formed into a shallow oval container shape and arranged to be secured integrally to the motor case 10 and a housing cover 22 for closing an opening of the housing 21. A printed circuit board 23 is fixedly disposed on the inner surface of the bottom of the housing 21. Moreover, the output shaft 14 of the motor passes through the printed circuit board 23 and projects into the housing 21. A main gear 24 comprising a large-diameter spur gear is secured to the output shaft 14 at a position above the printed circuit board 23. A sub-gear 25 comprising a spur gear having a diameter which is somewhat smaller than that of the main gear 24 is freely, rotatively supported by the output shaft 14 at a position opposite to the main gear 24 in the axial direction. At a position opposite to a portion of the outer surface of each of the main gear 24 and the sub-gear 25, an interlocking gear 27 arranged to be engaged to the main gear 24 and the sub-gear 25 is rotatively supported by a fixed shaft 26 standing erect on the inner surface of the bottom of the housing 21 and allowed to penetrate the printed circuit board 23. The interlocking gear 27 is composed of a first gear 28 arranged to be engaged to the main gear 24 and a second gear 29 having a diameter which is somewhat larger than that of the first gear 28 and arranged to be engaged to the sub-gear 25. The second gear 29 is engaged to a boss 28*a* provided for the first gear 28 such that separation in the axial direction is prevented. Thus, the first gear 28 and the second gear 29 are frictionally engaged to each other in the rotational direction. When the main gear 24 has been rotated by the output shaft 14 of the motor, the rotational force is transmitted to the sub-gear 25 through the interlocking gear 27, i.e., the first gear 28 and the second gear 29. At this time, the gear ratio of the main gear 24 and the first gear 28 and the gear ratio of the second gear 29 and the sub-gear 25 cause the sub-gear 25 to be rotated at rotational speed which is somewhat higher than that of the main gear 24 in the same direction as the rotation of the main gear 24.

Figure 5:
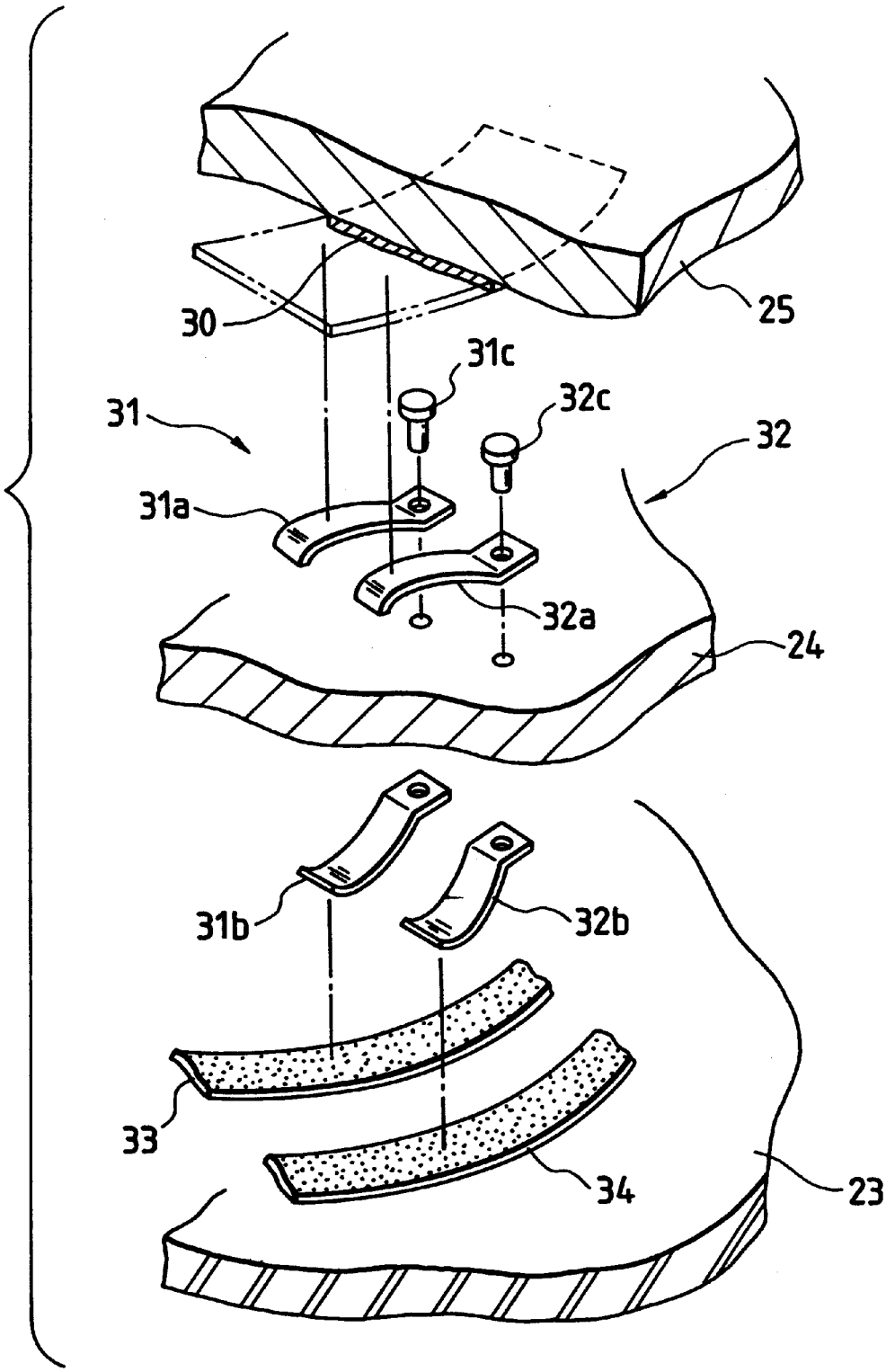
FIG. 5 is an enlarged view showing an essential portion of the operation of the position sensor.

The thickness of the lower surface of the sub-gear 25, which is the surface opposite to the main gear 24, is somewhat enlarged. A thick portion 25*a* is introduced into a circular and shallow recess 24*a* formed in the upper surface of the main gear 24 so as to be positioned thereon. At a substantially intermediate position in the radial direction of the lower surface of the thick portion 25*a* of the sub-gear 25, a conductive film 30 having a length in a predetermined circumferential direction and made of a metal plate is insert-molded so as to be flush with the sub-gear. At a position in the radial direction of the main gear 24 disposed opposite to the conductive film 30, there are disposed two contacts 31 and 32 penetrating the main gear 24 from the upper surface to the lower surface of the main gear 24. As shown in FIG. 5 in detail, the contacts 31 and 32 are composed of corresponding pairs of metal elastic members 31*a*, 31*b*, 32*a* and 32*b* which are disposed on the upper and lower surfaces of the main gear 24 to be opposite to one another and which are mechanically and electrically connected to one another by conductive connection pins 31*c* and 32*c*. The upper metal elastic members 31*a* and 32*a* are, by the elastic forces thereof, elastically brought into contact with the lower surface of the sub-gear 25. On the other hand, the lower metal elastic members 31*b* and 32*b* are, by the elastic forces thereof, elastically brought into contact with the surface of the printed circuit board 23. A projection 25*b* projecting into a radial direction is disposed in a portion of the circumference of the thick portion 25*a* of the lower surface of the sub-gear 25. A stopper 24*b* comprising a projection member projecting inwards is provided for a portion of the circumference of the shallow recess 24*a* of the upper surface of the main gear 24. The projection 25*b* and the stopper 24*b* are brought into contact with each other in the circumferential direction so that a relative amount of rotation between the main gear 24 and the sub-gear 25 is limited to one rotation or less.

Two annular circuit patterns 33 and 34 formed around the output shaft 14 of the motor at positions corresponding to the contacts 31 and 32 of the main gear 24 are provided for the upper surface of the printed circuit board 23. The contacts 31 and 32 are allowed to slide on the circuit patterns 33 and 34 when the main gear 24 has been rotated. Note that the circuit patterns 33 and 34 are extended to a connector 35 provided for the printed circuit board 23.

A third gear 36 arranged to be engaged to the main gear 24 is rotatively supported on the surface of the printed circuit board 23 in the housing 21 adjacent to the main gear 24. Moreover, a fourth gear 37 and a fifth gear 38 are rotatively supported at positions adjacent to the third gear 36. The third to fifth gears 36 to 38 are rotatively supported by fixed shafts 39, 40 and 41, respectively, which stand erect on the inner surface of the bottom of the housing 21. The fourth gear 37 is formed into a shape of a composite gear formed by coaxially integrating a small-diameter gear 37*a* arranged to be engaged to the third gear 36 and an intermediate-diameter gear 37*b* arranged to be engaged to the fifth gear 38. The gear ratios of the third gear 36 to the fifth gear 38 cause the fifth gear 38 to be rotated with respect to the main gear 24 in an accelerated state. The fifth gear 38 is formed into an annular shape in which a multi-pole magnet 42, having south poles and north poles disposed alternately, is integrally joined. A hall element 43 in which an electromotive force is generated when it has detected change in the magnetic flux is provided for the printed circuit board 23 at a position opposite to the multi-pole magnet 42. When the fifth gear 38 has been rotated, the multi-pole magnet 42 is rotated by dint of the foregoing rotation. Whenever the position opposite to the hall element 43 is switched between the south pole and the north pole, the hall element 43 outputs a pulse signal. Therefore, when the fifth gear 38 has been rotated one time, a plurality of pulse signals are output. Note that the multi-pole magnet 42 may be structured to comprise a small single magnet at a position along the circumference of the fifth gear 38.

With the position sensor 20, when the output shaft 14 is rotated by the motor 9, the worm 12 is integrally rotated. Therefore, the worm wheel 13 is rotated so that the output shaft 14 is rotated integrally with the worm wheel 13. The rotation of the output shaft 14 causes the drive pulley 16 to be rotated. Thus, the wire 4 is driven so that the window glass 7 is opened/closed. When the output shaft 14 has been rotated, the main gear 24 in the housing 21 is rotated. At this time, the above-mentioned gear ratios of the main gear 24, the sub-gear 25 and the interlocking gear 27 cause the main gear 24 and the sub-gear 25 to be rotated at different rotational speeds in the same direction. Therefore, the relative rotational angle positions between the two gears are gradually changed in accordance with an amount of the rotation of the output shaft 14 of the motor. Therefore, the contacts 31 and 32 of the main gear 24 are not in contact with the conductive film 30 of the sub-gear 25 at an initial position. When the output shaft 14 of the motor has been rotated by a predetermined amount of rotation due to the above-mentioned relative rotation between the main gear 24 and the sub-gear 25, the contacts 31 and 32 are brought into contact with the conductive film 30. Thus, the two contacts 31 and 32 are brought to a conductive state by dint of the conductive film. The conductive state is detected by the connector 35 through the circuit patterns 33 and 34 of the printed circuit board 23 which is always in contact with the two contacts 31 and 32. An amount of rotation of the output shaft 14 which is performed from the initial position to a moment of time at which the contacts 31 and 32 are electrically conducted by the conductive film 30 is designed to one-to-one correspond to the overall movement distance of the opening/closing operation of the window. In response to an output signal from the terminal 35, in a region from arrival of the window at a position adjacent to the full close position to the full close state, in other words, in the safety-control suspension region from the full close state of the window to a state in which the window is opened by a distance of 4 mm, a signal is output from the connector 35. Thus, the safety-control suspension region can accurately be recognized.

Figure 6:
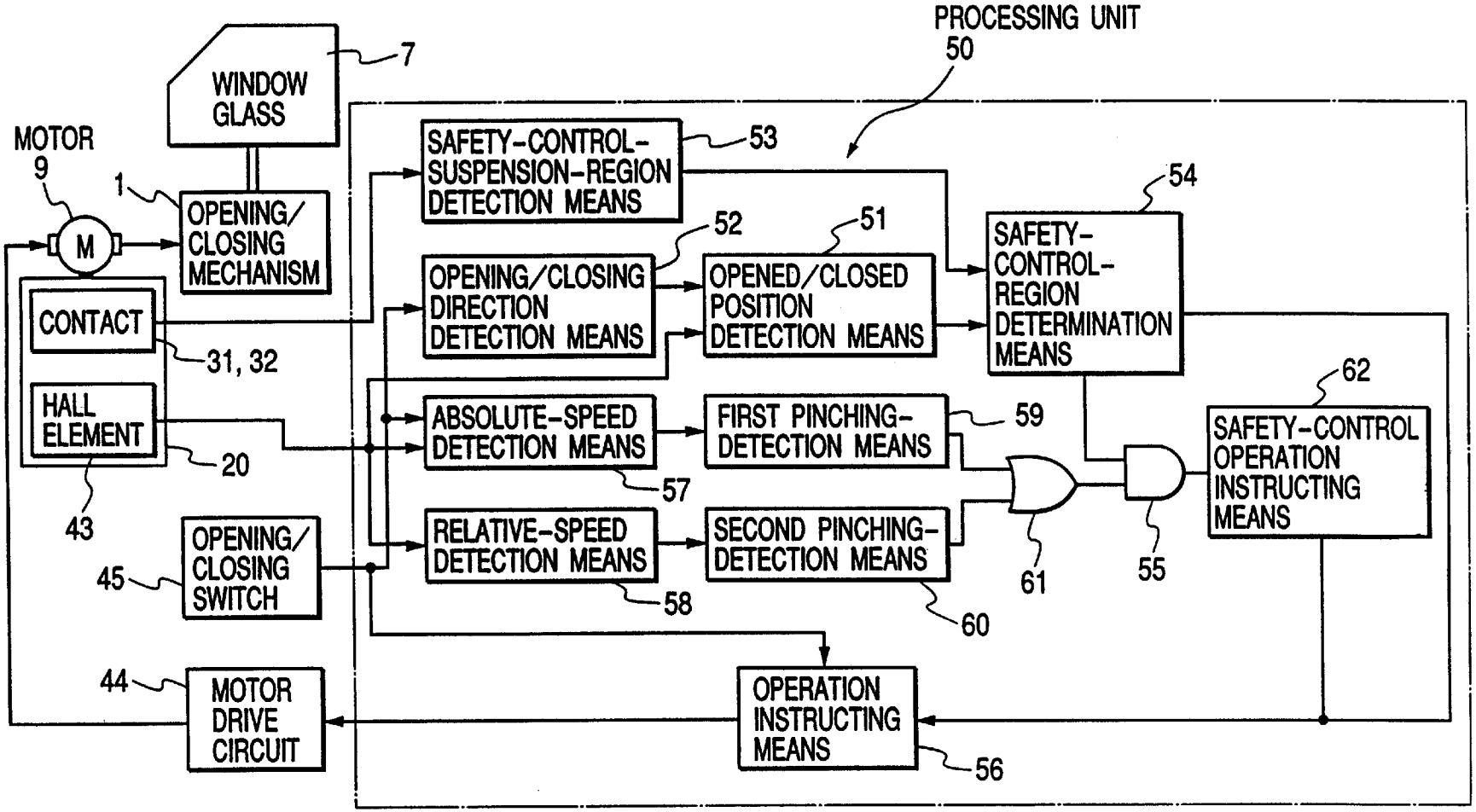
FIG. 6 is a block diagram showing a safety control operation circuit according to the present invention.
Figure 7:
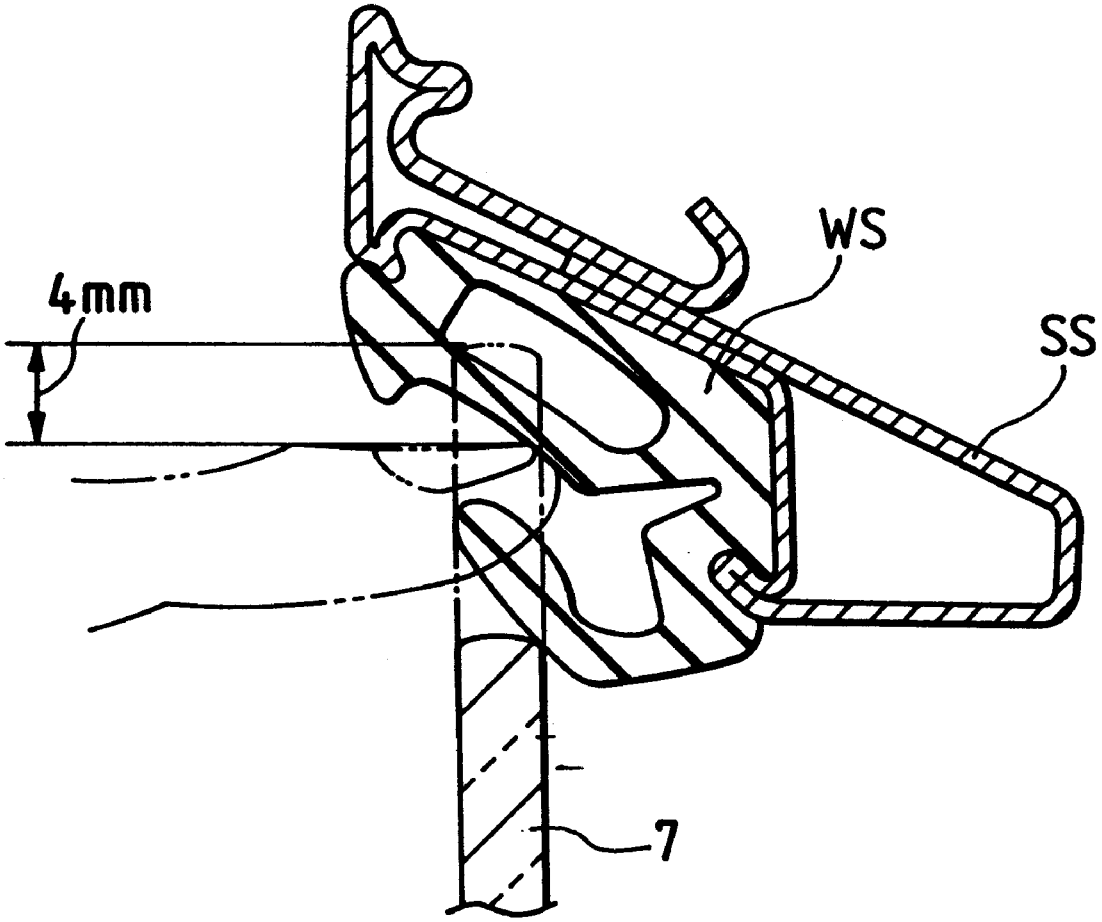
FIG. 7 PRIOR ART
FIG. 7 is a cross sectional view showing a safety-control suspension region provided for the window.

FIG. 6 is a block circuit diagram showing the overall structure of the safety apparatus incorporating the position sensor 20. The safety apparatus incorporates the opening/closing mechanism 1 for opening/closing the window glass 7; the motor 9 which is a drive source for operating the window opening/closing mechanism 1; the position sensor 20 for detecting opened/closed position of the window glass 7 realized by the motor 9; a motor rotating circuit 44 for rotating the motor 9; an opening/closing switch 45 which is operated when the window is opened/closed; and a processing unit 50 for controlling the opening/closing operation of the window in accordance with an output from the opening/closing switch 45 so as to perform a safety control operation for preventing pinching. The pulse signal output from the hall element 43 of the position sensor 20 is supplied to a window opened/closed position detection means 51. Moreover, the window opened/closed position detection means 51 is supplied with an output from the window opened/closed direction detection means 52 which detects an opening/closing direction of the window in accordance with an opening signal and a closing signal transmitted from the opening/closing switch 45. The window opened/closed position detection means 51 comprises, for example, an up-down counter. A count corresponding to a full close state of the window is initialized to "0". In response to the opening direction signal transmitted from the window opened/closed direction detection means 52, the pulse signals are counted in a negative direction. In response to the closing direction signal, the pulse signals are counted in the positive direction. In accordance with the counts, the opened/closed position of the window can be detected.

A safety-control-suspension-region detection means 53 is supplied with outputs representing the position and transmitted from the contacts 31 and 32 of the position sensor 20 to recognize a period of time in which the outputs indicate the safety-control suspension region so as to output a recognition signal to the safety-control-region determining means 54. An output from the window opened/closed position detection means 51 has been supplied to the safety-control-region determining means 54. In accordance with the output from the window opened/closed position detection means 51 and that from the safety-control-suspension-region detection means 53, the region in which the safety control is performed is determined in the region between the full open state of the window and a state immediately before full close of the window. A portion of the output from the safety-control-region determining means 54 is supplied to one of input terminals of an AND gate 55. Another portion of the output is supplied to an operation instructing means 56.

The pulse signal transmitted from the hall element 43 of the position sensor 20 is supplied to each of an absolute-speed detection means 57 and a relative-speed detection means 58. The absolute-speed detection means 57 detects a period of time from a moment at which the opening/closing switch 45 has been switched on to a first transition of a next pulse signal or the interval between first transitions of the pulse signals. Thus, the absolute-speed detection means 57 makes a comparison to determine whether or not rotational speed of the motor 9 for opening/closing the window glass 7, i.e., the opening/closing speed, is higher than predetermined reference speed. A first pinching-detection means 59 detects a state of pinching of foreign matter if the absolute speed is lower than the reference speed. If the rotational speed of the motor 9 is 20 ms/revolution or lower, the state of pinching is detected. The relative-speed detection means 58 detects time intervals of pulse signals which have sequentially been output to detect change in the speed of the opening/closing operation of the motor 9, i.e., the relative speed in accordance with the ratio of the time intervals. A second pinching-detection means 60 detects pinching of foreign matter if the relative speed is lower than a predetermined value. If the relative speed is reduced by 10% or more, the state of pinching is detected.

Outputs from the first and second pinching detection means 59 and 60 are supplied to input terminals of an OR gate 61. An output from the OR gate 61 is supplied to the other input terminal of the AND gate 55. An output from the AND gate 55 is supplied to a safety-control-operation instructing means 62. When the pinching detection signal has been supplied to the safety-control-operation instructing means 62, the safety-control-operation instructing means 62 controls the operation instructing means 56 to perform the safety control operation. In this embodiment, control is performed such that the window glass 7 is moved in an opening direction for a distance of 12 cm from the opened/closed position.

Therefore, the safety apparatus according to the present invention is able to recognize the opening/closing state and the opened/closed position of the window in response to the pulse signals supplied from the hall element 43 included in the position sensor 20. In accordance with the outputs from the contacts 31 and 32 of the position sensor 20, whether or not the window is positioned in the safety-control suspension region can be recognized. When the window is positioned in the safety-control region, the absolute speed and the relative speed of the opening/closing operation of the window are calculated in response to the pulse signal transmitted from the hall element 43. The calculated speeds are subjected to a comparison with the reference value so that pinching by the window is detected. When pinching has been detected, the motor rotating circuit 44 interrupts the rotation of the motor and the opening operation is performed in a predetermined quantity. Thus, safety can be assured.

When the position sensor 20 according to this embodiment is employed, the opened/closed position of the window, in particular, a position adjacent to the full close position of the window, can mechanically and electrically be detected. Thus, the safety-control suspension region for the window can be recognized and an error in detecting pinching can be prevented. Since the position sensor 20 is integrally formed with the motor 9, an additional space for disposing the position sensor adjacent to the window is not required. As a result, the structure in the vicinity of the window of the automobile can be simplified and space can be saved. Moreover, an error of the mounting position of the position sensor 20 does not cause an error in detecting the opened/closed position of the window. Since the conductive film 30 for detecting the state of rotation of the motor 9 is included in the position sensor 20, the number of elements required to constitute the safety control apparatus can be reduced. In addition, an advantage can be realized in that the number of steps for assembling the power window apparatus is reduced.

If fatigue of the weather strip or looseness of the wire 4 in the window opening/closing mechanism 1 results in the full close position of the window being moved in the closing direction, the relative position between the position of the window and the position sensor 20 is deviated. As a result, there is apprehension that an error occurs when the full close position is detected in accordance with the output voltage from the position sensor 20. Therefore, the foregoing embodiment is arranged such that the full close position is a state in which the projection 25*b* of the sub-gear 25 is in contact with either end surface of the stopper 24*b* of the main gear 24. Moreover, a structure in which the main gear 24 and the sub-gear 25 are frictionally joined to each other in the rotational direction is employed. In this embodiment, the interlocking gear 27 has a structure that the second gear 29 is engaged to the boss 28*a* of the first gear 28 so that a frictional joint is realized. Therefore, the first and second gears 28 and 29 perform relative rotation. If the output shaft 14 of the motor is furthermore rotated even after the main gear 24 and the sub-gear 25 have been rotated and the window has reached the full close position, the main gear 24 integrally provided for the output shaft 14 and the first gear 28 arranged to be engaged to the main gear 24 are slid and idly rotated with respect to the second gear 29. When the rotation of the motor has been interrupted after the window has reached the full close position, the main gear 24 is brought to a state in which the projection 25*b* of the sub-gear 25 and the stopper 24*b* are in contact with each other. As a result, the relative rotational position between the two gears 24 and 25 and the initial rotational position between the gears 24 and 25 are set. Note that the foregoing operation is similarly performed when the output shaft of the motor has been rotated in the opposite direction, i.e., when the window is positioned in the full open state. The main gear 24 and the sub-gear 25 are brought into contact with the stopper 24*b* on the end surface opposite to the projection 25*b*. At this time, the main gear 24 is idly rotated. Thus, the actual full open position of the window and the relative rotational position between the main gear 24 and the sub-gear 25 are set.

The conductive film 30 of the sub-gear 25 according to this embodiment may be constituted by a resistance film to detect change in the relative rotational position between the main gear and the sub-gear so that the position of the window in the safety-control suspension region is further precisely detected. The positions of the main gear and the sub-gear may be changed such that the conductive film is provided for the main gear and the contact is provided for the sub-gear. The multi-pole magnet may integrally be provided for the first gear. In the foregoing case, the third to fifth gears can be omitted from the structure. Although the foregoing embodiment has been described about the structure in which the hall element is integrally formed with the position sensor, a structure in which the hall element is not included may, of course, be employed. For example, a power window apparatus adapted to a method by which pinching in the window is detected in accordance with an electric current in the motor is structured such that the hall element is not included. Also in the foregoing case, the third to fifth gears can be omitted from the structure. In place of the hall element, a rotational brush structure may be disposed between the first gear or the fifth gear and the printed circuit board to obtain the pulse signals from the rotational brush structure when the rotational brush structure is rotated.

As described above, according to the present invention, the position sensor is provided which detects a region adjacent to the full close position of the window in accordance with the amount of rotation of the rotational output shaft of the motor. The position sensor incorporates the main gear and the sub-gear arranged to be rotated by the output shaft of the motor at different rotational speeds, the contact provided for either of the two gears and the conductive film provided for the other gear. In response to an electric signal output by dint of the contact between the conductive film and the contact made when the main gear and the sub-gear are brought to a predetermined relative rotational state, the safety-control suspension region is detected. Therefore, an error in detecting pinching occurring when safety control for the power window apparatus is performed can be prevented. Thus, a reliable safety control operation can be performed. Since the present invention has the structure that the main gear and the sub-gear are rotated through the frictionally joined interlocking gear, the full close position of the window or the full open position of the window, the relative rotational position between the main gear and the sub-gear and the initial rotational position which is the reference for the gears can automatically be set. Thus, the opened/closed position can accurately be detected.

What is claimed is:

1. A power window apparatus having a safety unit, comprising:

a position sensor which defects an opened/closed position of a window, said window being opened/closed by a motor, with said position sensor initiating a pinch preventive safety control operation in accordance with the detected opened/closed position of said window, wherein said position sensor includes a main gear rotated by an output shaft rotated by said motor; a sub-gear disposed adjacent to said main gear in the axial direction and rotated by a mechanism provided for rotating said sub-gear at a rotational speed different from a rotational speed of said main gear, wherein a contact is provided for said main gear and a conductive film is provided for said sub-gear, and in an initial position where said contact and said film are not engaged, and after movement along a set of loci, said contact and said film engage thereby completing an electrical circuit which produces a position detection signal.

2. A power window apparatus having a safety unit according to claim 1, wherein said main gear and said sub-gear are composed of spur gears having different numbers of teeth and said mechanism for rotating includes an interlocking gear so that a rotational force is transmitted from said main gear to said sub-gear, said interlocking gear is composed of a first gear engaged to said main gear and a second gear engaged to said sub-gear, wherein said first and second gears are coaxially interlocked by frictional engagement.

3. A power window apparatus having a safety unit according to claim 2, where said position sensor is provided with a gear which is rotated by said main gear, a magnet provided for at least a portion of the circumference of said gear and a hall element disposed adjacent to said gear and arranged to detect a state of rotation of said magnet performed by the rotation of said gear, and at least the opened/closed position of said window is detected in response to a pulse signal output from said hall element.

4. A power window apparatus having a safety unit according to claim 2, wherein said position sensor is provided with a gear which is rotated by said main gear, a magnet provided for at least a portion of the circumference of said gear and a hall element disposed adjacent to said gear and arranged to detect a state of rotation of said magnet performed by the rotation of said gear, wherein pinching in said window is detected in response to a pulse signal output from said hall element.

* * * * *